US005167609A

United States Patent [19]

Graw et al.

[11] Patent Number: 5,167,609

[45] Date of Patent: Dec. 1, 1992

[54] CENTRIFUGE WITH A VERTICAL AXIS OF ROTATION

[75] Inventors: Georg Graw, Cliffside Park, N.J.; Werner Kohlstette, Oelde, Fed. Rep. of Germany; Herbert Hohmann, Oelde, Fed. Rep. of Germany; Detlef Grabbe, Oelde, Fed. Rep. of Germany

[73] Assignee: Westfalia Separator AG, Oelde, Fed. Rep. of Germany

[21] Appl. No.: 693,750

[22] Filed: Apr. 30, 1991

[30] Foreign Application Priority Data

May 7, 1990 [DE] Fed. Rep. of Germany ..... 4014552

[51] Int. Cl.[5] ..... B04B 11/00

[52] U.S. Cl. ..... 494/023; 494/27

[58] Field of Search ..... 494/23, 25, 26–28, 494/43, 56–58, 38, 39, 41, 63, 67, 85; 366/184; 210/369, 371–376, 776, 781, 210, 198.1

[56] References Cited

U.S. PATENT DOCUMENTS

| | | | |
|---|---|---|---|
| 2,917,230 | 12/1959 | Kaldewey | 494/63 X |
| 3,371,858 | 3/1968 | Shapiro | 494/38 X |
| 3,494,545 | 2/1970 | Nilson | 494/26 X |
| 3,519,200 | 7/1970 | Nilson | 494/26 X |
| 3,563,453 | 2/1971 | Kompert et al. | 494/26 X |
| 3,580,493 | 5/1971 | Jonsson | 494/26 X |
| 4,305,817 | 12/1981 | Kohlstette | 210/371 X |
| 4,417,885 | 11/1983 | Kohlstette et al. | 494/23 |
| 4,718,886 | 1/1988 | Mackel | 494/58 |
| 4,718,887 | 1/1988 | Gunn | 494/58 |
| 4,820,256 | 4/1989 | Nordstrom | 494/27 X |
| 5,041,075 | 8/1991 | Bruning et al. | 494/57 X |

FOREIGN PATENT DOCUMENTS

| | | | |
|---|---|---|---|
| 823125 | 11/1951 | Fed. Rep. of Germany | 494/41 |
| 8130833 | 3/1982 | Fed. Rep. of Germany . | |
| 2515066 | 4/1983 | France | 494/38 |

*Primary Examiner*—Philip R. Coe
*Assistant Examiner*—C. Cooley
*Attorney, Agent, or Firm*—Sprung, Horn Kramer & Woods

[57] ABSTRACT

The peeling chamber in a head of a centrifuge has an upstream barrier chamber that seals it off from the atmosphere. A barrier disk secured to a peeler extends into the barrier chamber. Compressed gas is supplied to between barrier disk and peeler through a channel to prevent gas from escaping from the solvent. Another channel supplies liquid to the barrier chamber. Solvent from the periphery is supplied to the barrier chamber through a channel and simultaneously by the peeler through the barrier-liquid channel. An area of separation becomes established between the two liquids in the barrier chamber. If any solid particles enter the barrier chamber as the result of gas leaving the solvent, they will dissolve again in the solvent in the periphery of the barrier chamber and will be prevented from making the chamber malfunction.

3 Claims, 1 Drawing Sheet

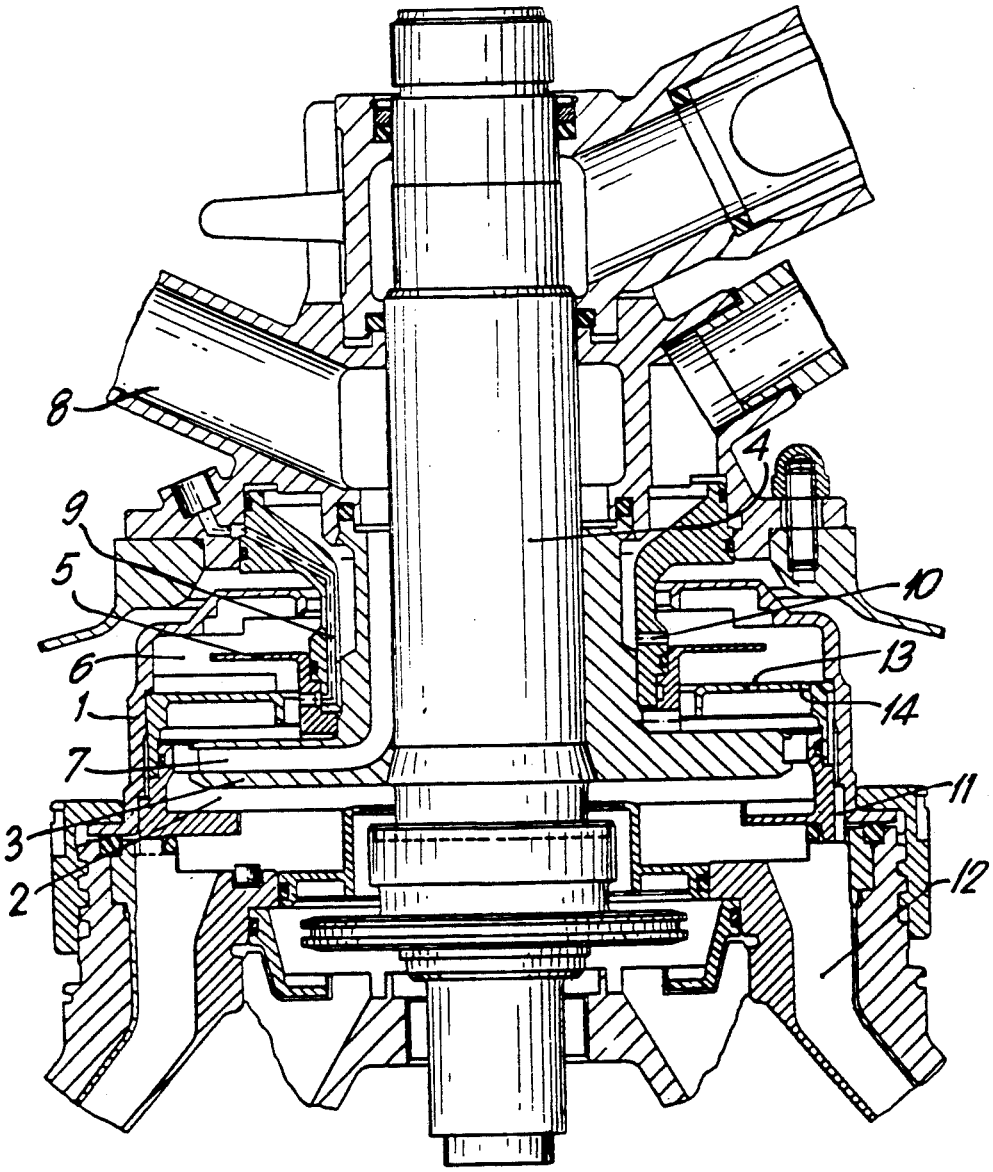
8
9
5
6
1
7
3
2
4
10
13
14
11
12

CENTRIFUGE WITH A VERTICAL AXIS OF ROTATION

BACKGROUND OF THE INVENTION

The invention concerns a centrifuge with a vertical axis of rotation, with a drum accommodating a peeling chamber that communicates through at least one diversion channel with the drum's separating space, with a peeler in the peeling chamber constantly diverting a liquid phase that has been clarified or separated in the drum, and with a barrier disk above the peeling chamber, rigidly secured to the peeler, and extending into a barrier chamber that rotates with the drum, whereby the peeling chamber has a channel for supplying a compressed gas to below the barrier disk and another channel for supplying barrier fluid to the barrier chamber.

A centrifuge of this type is known from German GM 8 130 833 for example. The pressurized gas moves the fluid up and down below the barrier disk and above the peeler. The purpose is to prevent barrier fluid from leaking into the peeling chamber over the inside diameter of the bottom barrier chamber. The barrier chamber is filled with barrier fluid either constantly or intermittently through a special channel.

When solvents that have solid matter dissolved in them are separated, solids can deposit in the barrier chamber as a result of gas leaving a solvent. The solid particles can clog up the barrier chamber and make it malfunction.

SUMMARY OF THE INVENTION

The object of the present invention is to improve the centrifuge to the extent that the solid matter dissolved in the solvent will not clog up the barrier chamber.

This object is attained in that the periphery of the barrier chamber communicates with the diversion channel through at least one channel.

The barrier chamber is supplied with solvent from the periphery through this channel and simultaneously by the peeler with barrier fluid from a radially inner zone. An area of separation becomes established between the two liquids in the barrier chamber. If any solid particles enter the barrier chamber as a result of gas leaving the solvent, they will dissolve again in the solvent in the periphery of the barrier chamber and will be prevented from making the chamber malfunction.

A central region in the barrier chamber in one practical embodiment communicates with the peeling chamber through at least one other channel.

Some of the incoming barrier liquid flows constantly through the second channel into the peeling chamber, where it mixes with the solvent. The barrier fluid in this version simultaneously acts as a rinse, which considerably reduces expenditure.

A zone between the first and second channel in another practical embodiment communicates with the peeling chamber through at least one more channel.

Some of the solvent in the barrier chamber flows constantly into the peeling chamber through the third channel. This subsidiary stream is constantly replenished through the first channel. The result is a constant interchange between the solvents in the barrier chamber, ensuring a constant supply of solvent for the solids entering the barrier chamber.

One embodiment of the invention is described in detail hereinafter with respect to the drawing wherein.

BRIEF DESCRIPTION OF THE DRAWING

The Figure is a cross section of a centrifuge according to the invention.

DETAILED DESCRIPTION OF THE INVENTION

The head 1 of a centrifuge has a peeling chamber 2 accommodating a stationary peeler 3. Communicating with the peeler are an intake 4 and a barrier disk 5 that extends into a barrier chamber 6. Peeler 3 accommodates channels 7 that divert a separated liquid phase that is removed from the centrifuge through an outlet 8. Peeler 3 also has a channel 9 that supplies a compressed gas and another channel 10 that supplies barrier liquid to barrier chamber 6. Channels 11 extend from the periphery of barrier chamber 6 to a diversion channel 12 that connects a separation space in the drum to the inside of peeling chamber 2. Channels 13 extend from a central region of barrier chamber 6 into peeling chamber 2, and channels 14 extend from chamber 6 into the a zone between first channels 11 and second channels 13.

Product is supplied to the centrifuge through intake 4 and broken down into its constituents. A liquid constituent is supplied to peeling chamber 2 through diversion channel 12 and then diverted out under pressure through peeler 3. Barrier liquid is constantly supplied to barrier chamber 6 through barrier-liquid channel 10, whence it arrives in peeling chamber 2 by way of second channels 13. It mixes with the exiting liquid phase in the peeling chamber.

To prevent gas from escaping from the solvent in the product, gas is supplied through channel 9 to between barrier disk 5 and peeler 3 at a pressure higher than the partial pressure of the solvent.

Solvent is supplied to barrier chamber 6 at its periphery through initial channel 11 and simultaneously by peeler 3 through barrier-liquid channel 10. An area of separation becomes established between the two liquids in the barrier chamber. If any solid particles enter the barrier chamber as a result of gas leaving the solvent, they will dissolve again in the solvent in the periphery of the barrier chamber and will be prevented from making the chamber malfunction.

Solvent is constantly supplied to peeling chamber 2 from barrier chamber 6 through third channels 14. This solvent is constantly replenished through first channels 11 The result is a constant supply of fresh solvent for the solids entering the barrier chamber.

The barrier liquid supplied through barrier-liquid channel 10 flows through barrier chamber 6 and enters peeling chamber 2, where it mixes with the solvent and hence acts as a rinse.

The mixed liquids are diverted out of the centrifuge through peeler 3 and can be further separated during a later stage.

What is claimed is:

1. A centrifuge with a vertical axis of rotation, comprising a drum having a separating space, a peeling chamber in the drum, at least one diversion channel providing communication between the peeling chamber and the separating space, a peeler in the peeling chamber for constantly diverting a liquid phase that has been clarified or separated in the drum, a barrier chamber that rotates with the drum and a barrier disk above the peeling chamber rigidly secured to the peeler, and extending into the barrier chamber, means for supplying a compressed gas to the peeling chamber, said peeling chamber having a first channel for feeding the compressed gas to a location below the barrier disk means for supplying a barrier fluid which comprises a second channel for feeding the barrier fluid to the barrier chamber and means providing communication between a periphery of the barrier chamber and the at least one diversion channel comprising at least one third channel.

2. The centrifuge as in claim 1, further comprising at least one fourth channel for providing communication between a central region of the barrier chamber and the peeling chamber.

3. The centrifuge as in claim 1, wherein a zone between the at least third and fourth channels communicates with the peeling chamber through at least one fifth channel.

* * * * *